United States Patent [19]

Bell

[11] Patent Number: 4,768,254

[45] Date of Patent: Sep. 6, 1988

[54] PAINT SCRAPER TOOL

[76] Inventor: David D. Bell, 3315 SW. Ridge Dr., Portland, Oreg. 97219

[21] Appl. No.: 912,920

[22] Filed: Sep. 29, 1986

[51] Int. Cl.[4] ..... A47L 13/022

[52] U.S. Cl. ..... 15/236.01; 15/143 R; 30/172; D32/49

[58] Field of Search ..... 15/111, 236 R, 244 C, 15/244 A, 143 R; 30/169, 172, 267; D32/46, 48, 49

[56] References Cited

U.S. PATENT DOCUMENTS

| | | | |
|---|---|---|---|
| 161,181 | 3/1875 | Tuckerman | 30/172 X |
| 578,960 | 3/1897 | Wilder | 30/172 X |
| 586,164 | 7/1897 | Denere | 15/236 R |
| 822,928 | 6/1906 | Delano | 15/236 R |
| 1,068,731 | 7/1913 | Blum | 15/236 R |
| 2,291,015 | 7/1942 | Anderson | 15/236 R |
| 3,955,234 | 5/1976 | Roefaro | 15/236 R |
| 4,481,689 | 11/1984 | Westmoreland | 15/236 R |

*Primary Examiner*—Peter Feldman

*Attorney, Agent, or Firm*—Chernoff, Vilhauer, McClung & Stenzel

[57] ABSTRACT

A paint scraper for removing paint from wooden or other soft surfaces without damage to such surfaces includes a shaft and a blade oriented at a slightly obtuse angle with respect to the axis of the shaft and a concave deflecting shank extending from a blade support portion to a handle portion for guiding peeling paint away from the vicinity of the blade. The blade is relatively sharp and thin, but is kept from oscillating by the support portion of the shaft which includes a lip which allows attaching parts to prestress the blade so that it remains stiff.

5 Claims, 2 Drawing Sheets

PAINT SCRAPER TOOL

BACKGROUND OF THE INVENTION

The present invention relates to a paint scraper for removing paint from wooden surfaces with relative ease and without damaging the wood beneath the paint.

Paint scrapers are commonly used for removing paint from surfaces such as brick, cement, metal or wood, and all have similar features. Typically, a paint scraper includes a handle adapted to be gripped by a user, and a blade affixed to the end of the handle. The typical paint scraper is pulled across the surface from which paint is to be removed, and the blade is therefore oriented with respect to the handle at substantially a 90° angle or a slightly acute angle pointing in the direction of the pulling motion. Conventional paint scrapers can be constructed which are adequate for removing paint from hard surfaces such as brick and metal; however, such devices are inadequate for removing paint from wood as will be explained below. Another type of paint scraper is the conventional putty knife. The blade of a putty knife is pushed into the paint rather than pulled across the paint as are the paint scrapers described above. Pushing the blade, however, makes the blade tend to dig into and damage the wood underneath the paint.

There are two primary design considerations which must be addressed in order to optimize a paint scraper for the particular use envisioned. The first consideration is stiffness of the blade. A stiff blade will provide the best paint removing ability and will work well on hard surfaces such as metal and brick. The blade may be made stiff either by making the blade very thick or by making it very short in relation to its thickness. Either way, a thick blade will have less of a tendency to oscillate as it is pulled across the painted surface. Unfortunately, very thick blades cannot be used with wooden surfaces because the blade would tend to damage the wood beneath the paint. Paint is much harder than wood, and although a thick blade can penetrate the protective shield formed by the paint over the wood, it has a tendency to dig into the wood. It is possible to decrease the thickness of the blade and make the blade sharper and more slender, but if the blade loses its stiffness it will "chatter" and tend to create a washboard effect on a wooden surface from which it is desired to remove the paint.

Moreover, conventional paint scrapers do not allow for the increase in resistance to the direction of pulling motion due to the buildup of paint in the vicinity of the blade. As the scraper is used, paint scraps accumulate under the blade which must be removed at short intervals so that the motion of the tool is not impeded. The constant removal of paint scraps is time-consuming because the blade can usually travel no more than a few inches before it becomes necessary to remove them.

SUMMARY OF THE INVENTION

The present invention comprises a shaft having a blade mounted thereon at a slightly obtuse angle to the longitudinal axis of the shaft. The shaft includes a handle portion adapted to be gripped by a user, and a blade support portion which supports the blade which is affixed to the end of the shaft. Between the blade portion and the handle is a curved paint deflecting shank which provides a surface for guiding paint away from the blade as the scraper is pulled across a surface so as to peel paint away.

The curved paint-deflecting shank is in the form of a gradually narrowing neck which extends from the handle to a narrow midpoint and then gradually expands in diameter to form a broad base of support for the blade, which prevents the blade from oscillating or chattering. The base also includes a raised lip at the front so that the blade may be prestressed when mounting it to the base by a screw or other means. This stiffens the blade to make it less susceptible to chattering.

The area of the end of the blade support portion of the shaft is large enough to provide proper support for the blade, but, the support portion does not interfere with the paint as it is peeled away from a surface because the concave paint-deflecting shank begins at an outer edge of the blade support portion at the end of the handle. Therefore, directly beneath the blade there exists a nearly continuous curve which allows the paint to be peeled away without forming any resistance to the direction of motion of the tool.

The handle includes an outer end portion which extends away from its longitudinal axis at an obtuse angle in the direction of the blade. This forms a stop to prevent the tool from slipping from the grip of a user. Thus gripped, the handle remains securely in the hand of the user as it is pulled across a painted surface.

It is a principle object of this invention to provide a paint scraper for easily and efficiently removing paint from soft surfaces such as wood without damaging such surfaces.

A further object of this invention is to provide a paint scraper having a means for deflecting peeled paint away from the blade of the paint scraper, thereby decreasing its resistance to motion, and providing for longer and more efficient paint removing strokes of the tool.

Yet a further object of the invention is to provide a paint scraper whose blade does not chatter or create a washboard effect on the surface from which paint is to be removed.

A further object of this invention is to provide a paint scraper which may be gripped securely by a user and which will not slip out of the user's hand.

The foregoing and other objectives, features and advantages of the present invention will be more readily understood upon consideration of the following detailed description of the invention taken in conjunction with the accompanying drawings.

DETAILED DESCRIPTION OF THE INVENTION

Referring to FIGS. 1*a*–1*d*, prior art paint scrapers 2*a*, 2*b*, 2*c* and 2*d*, respectively, each include handles 3*a*, 3*b*, 3*c* and 3*d*, respectively, and blades 4*a*, 4*b*, 4*c* and 4*d*, respectively. Paint scraper 2*a* includes blade 4*a* which is oriented at an acute angle with respect to the opposite end of handle 3*a*. Blades of the type illustrated by blade 4*a* typically include a bevel of 45° . The blade 4*a* is a short, rigid blade which is suitable for removing paint from hard objects but which will damage wood. The aforementioned problem is aggravated by the design of paint scraper 2*b* which includes a very short, very rigid blade 4*b* which typically includes no bevel at all or a bevel of slightly less than 90° . This blade is too rigid and blunt to remove paint from soft surfaces such as wood. Paint scraper 2*c* is similar to paint scraper 2*a* and includes a blade having a bevel of approximately 45°. This also means that the minimum angle of attack (the angle between the blade and the painted surface) can be no less than 45° . This angle is too steep to avoid damaging the wood beneath the paint. Also, with the paint scraper 2*c*, paint tends to accumulate in the space beneath the blade 4*c* and the handle 3*c*, thus creating considerable resistance to the motion of the blade in the direction indicated by the arrow. This problem is common to all four of the paint scrapers 2*a*, 2*b*, 2*c* and 2*d*. Paint scraper 2*d* also includes a blade having a bevel which is typically in the 50°–60° range which, like paint scraper 2*c*, is unsuitable for wooden surfaces.

Figure 3:
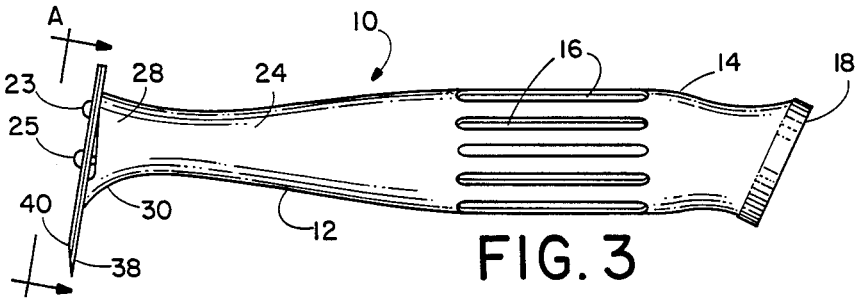
FIG. 3 is a side view of a paint scraper constructed according to the present invention.
Figure 4:
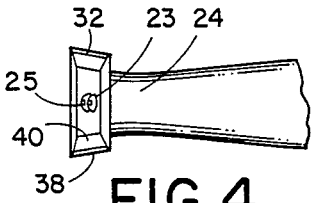
FIG. 4 is a partial top view of the paint scraper of FIG. 3.

Referring to FIG. 3, a paint scraper 10 constructed according to the invention, comprises a single-piece shaft 12 which includes a handle portion 14 which may have flutes or ridges 16. The handle 14 may also include an angled end portion 18 which extends downward at an angle away from the longitudinal axis of the shaft 12 so as to form a stop to prevent a user's hand from slipping toward the rear as the scraper 10 is pulled in the direction of the arrow shown in FIG. 7.

Figure 1A:
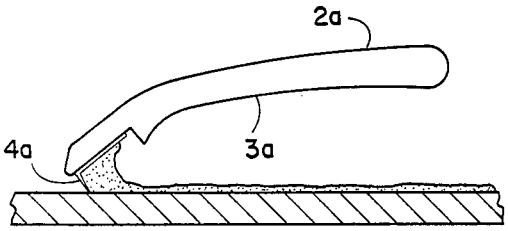
FIG. 1A is a side elevation view of a prior art paint scraper.
Figure 1B:
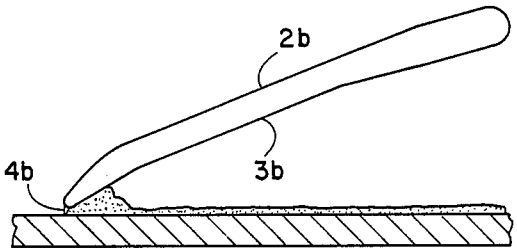
FIG. 1B is a side elevation view of another type of prior art paint scraper.
Figure 1C:
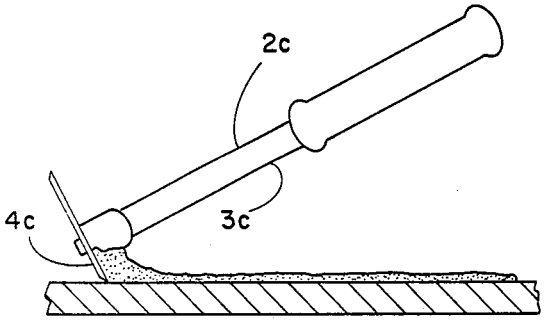
FIG. 1C is a side elevation view of yet another type of prior art paint scraper.
Figure 1D:
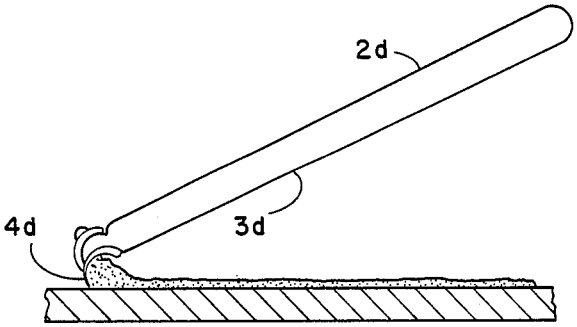
FIG. 1D is a side elevation view of another type of prior art paint scraper.
Figure 2:
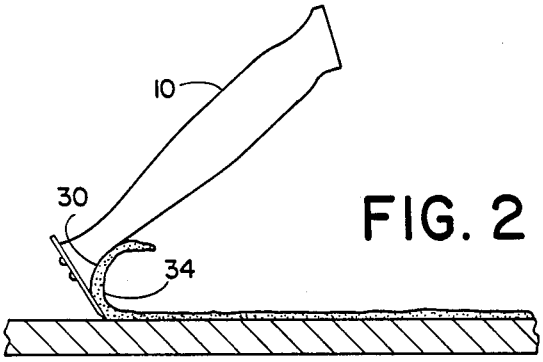
FIG. 2 is a side elevation view of the paint scraper of the present invention being used on a painted surface.

From the handle portion 14, the shaft 12 forms a gradually narrowing neck 24 which narrows from the handle portion 14, then gradually increases in diameter to form a blade support portion 28. The blade support portion is relatively long, extending directly along the blade for more than half of its length. The neck 24 thereby forms a continuous curved paint-deflecting concave surface 30 which begins directly at the end of blade support portion 28, and at the outer edge thereof, to provide a continuous, curved, unobstructed pathway from the blade to the shaft for peeling away paint 34 as best shown by reference to FIG. 2.

Figure 5:
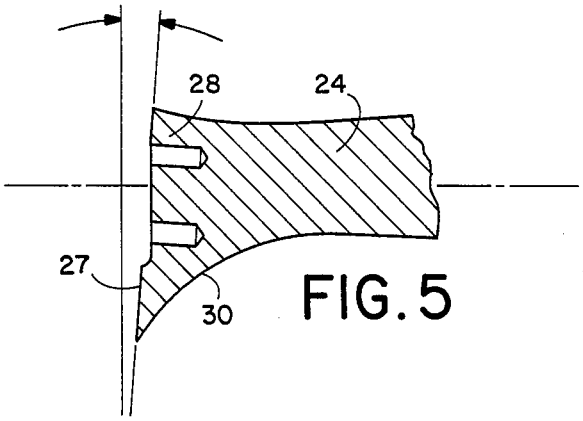
FIG. 5 is a partial cutaway side view of the handle of the paint scraper of FIG. 3 taken along line A—A of FIG. 3.

The blade 32 is affixed to the end portion 28 of shaft 12 by a pair of screws 23 and 25. The support portion 28 includes a lip 27 at its forward end (see FIG. 5). When a blade 32 is fastened to the support portion 28 the lip 27 enables the forward screw 25 to prestress the blade 32 by exerting pressure on its top surface. This helps to alleviate the chattering effect caused by unwanted oscillation of the blade 32. The lip 27 has a height of approximately 0.020 inch which orients the blade 32 at a 95° angle with respect to the horizontal axis (dash-dot line in FIG. 5) of the shaft 12. This makes the angle shown between the arrows in FIG. 5 equal to approximately 5°. The advantage of this orientation, apart from prestressing the blade 32, is that the paint scraper may be used in corners, at the bases of walls, or any location at which two perpendicular surfaces intersect. This is due to the fact that with this geometry the tip of the blade 32 can reach into corners unhindered by the blade end of the handle 14.

Figure 6:
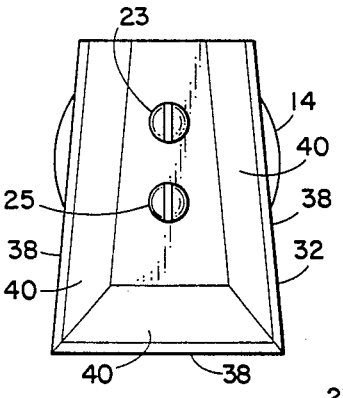
FIG. 6 is an end view of the paint scraper of FIG. 3.

As shown best in FIG. 6, the blade 32 includes three bevelled surfaces which add to its flexibility. Thus, the handle 14 may be grasped or turned in a variety of ways and a working edge will be available. The edges of blade 32 are bevelled first at an angle of between 15° and 20° at the tips 38 and again at an angle of between 7° and 20° along top surfaces 40. This makes the blade relatively sharp which allows it to penetrate paint. Although this dual-bevelling also makes the blade relatively thin, excessive oscillation is contained by the use of the broad support base portion 28 of the shaft 12 and the prestressing of the blade 32 by screws 25 and 23 exerting pressure on the blade 32 at lip 27.

Figure 7:
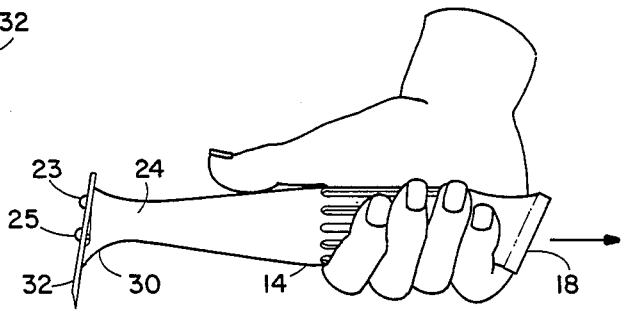
FIG. 7 is a side view of the paint scraper of FIG. 3 being held by a user.

As the paint scraper 10 is pulled in the direction of the arrow in FIG. 7, paint peels along the concave deflecting surface 30 without accumulating under the blade 32. This allows the paint scraper 10 to smoothly strip away a layer of paint from a surface with long even strokes without excessive blade chatter and without undue damage to the wood beneath.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A paint scraper tool comprising a shaft having a flat blade mounted thereon at a predetermined angle to the longitudinal axis of said shaft, said shaft including a handle portion adapted to be gripped by a user, a blade support portion comprising a base area extending directly along the blade for more than half of its length for supporting said blade, and a curved paint deflecting shank beginning at a forward end of said base area directly contacting said blade, and curving away therefrom, forming a continuous, gently curving, unobstructed concave surface from the blade to the shaft for guiding peeling paint away from said blade.

2. The paint scraper of claim 1 wherein said curved paint deflecting shank comprises a gradually narrowing neck in said shaft extending from said handle portion toward said blade which narrows and then gradually expands in diameter from its narrowest point to form said blade support portion.

3. The paint scraper of claim 1 wherein said handle portion includes an outer end extending away from said longitudinal axis at an angle so as to form a stop to prevent the paint scraper from slipping from a user's hand.

4. The paint scraper of claim 1 wherein said blade includes three bevelled edges.

5. A paint scraper comprising a shaft having a blade mounted thereon at a predetermined angle to the longitudinal axis of said shaft, said shaft including a handle portion adapted to be gripped by a user and a blade support portion comprising a base area for supporting said blade, wherein said blade support portion includes a raised lip located at a forward portion of said blade support portion, and attaching means for mounting said blade to said blade support portion so as to prestress said blade, said attaching means including threaded means inserted through said blade and into said shaft rearwardly of said raised lip, and a curved paint deflecting shank situated between said blade support portion and said handle portion for providing a surface for guiding peeling paint away from said blade.

* * * * *